United States Patent [19]

Clark et al.

[11] 4,432,541

[45] Feb. 21, 1984

[54] RECIRCULATING DOCUMENT FEED APPARATUS AND METHOD FOR ALIGNING DOCUMENTS THEREIN

[75] Inventors: William D. Clark, Longmont; Mark D. Garner, Boulder; John H. Rhodes, Jr., Longmont; Bernard L. Wilzbach, Berthoud, all of Colo.

[73] Assignee: International Business Machines Corporation, Armonk, N.Y.

[21] Appl. No.: 296,684

[22] Filed: Aug. 27, 1981

[51] Int. Cl.[3] ..... B65H 9/16

[52] U.S. Cl. ..... 271/251; 271/301

[58] Field of Search ..... 271/251, 301, 272, 273, 271/274

[56] References Cited

U.S. PATENT DOCUMENTS

| | | | |
|---|---|---|---|
| 3,409,366 | 11/1968 | Hanson et al. | 355/102 |
| 3,510,218 | 5/1970 | Limberger et al. | 355/51 |
| 3,661,383 | 5/1972 | Morrison | 271/51 |
| 3,770,348 | 11/1973 | Martin | 271/301 X |
| 4,052,054 | 10/1977 | Cardwell | 271/251 X |
| 4,056,320 | 11/1977 | Mochimaru et al. | 355/75 |
| 4,062,533 | 12/1977 | Greenberg et al. | 271/10 |
| 4,179,117 | 12/1979 | Rhodes, Jr. | 271/251 |
| 4,316,667 | 2/1982 | Edwards | 271/301 X |

OTHER PUBLICATIONS

IBM Tech. Disc. Bulletin, vol. 24, No. 1B, Jun. 1981, pp. 808–809, "Recirculating Document Feed with Dual Entry Gate", by W. D. Clark et al.

IBM Tech. Disc. Bulletin, vol. 24, No. 1B, Jun. 1981, pp. 821–822, "Scanning Fiber-Optic Bundle Copier with Recirculating Document Feed", by W. D. Clark et al.

*Primary Examiner*—Richard A. Schacher

*Attorney, Agent, or Firm*—C. E. Rohrer

[57] ABSTRACT

A document feed device, illustrated with a copier machine, for recirculating documents through a processing station. A movable portion of the document feed device is mounted for pivoting movement to expose a lower document feed path. The movable portion contains several document moving rollers but no prime movers, gears or belts; these rolls are driven by frictional contact with each other and ultimately by contact with a set of driven rollers located in the nonmoving portion of the document feed device. The rollers comprising a document moving nip are oppositely skewed relative to the direction of document travel in order to move documents gently toward a reference edge and coefficients of friction of roller materials are chosen to insure correct document alignment.

3 Claims, 4 Drawing Figures

RECIRCULATING DOCUMENT FEED APPARATUS AND METHOD FOR ALIGNING DOCUMENTS THEREIN

This invention relates to a recirculating document feed device and more particularly, to a device which includes a pivoting portion containing no prime movers and a method for aligning documents despite slippage in document moving roll nips.

BACKGROUND OF THE INVENTION

Paper moving schemes appearing in the art are numerous and include such devices as vacuum belts, vacuum trays, wave generators, large diameter rollers, soft high friction rollers, hard high friction rollers, and leading edge pullers. Means of moving, turning, or transporting said devices include chains, belts, blowers, etc. driven by a prime mover such as a motor.

In recirculating document feed devices, a document is passed through a processing station and then recirculated so that it passes through the processing station again. The cycle can be repeated any number of times until the desired number of processing steps have been completed. Recirculating document feed devices ordinarily use paper moving schemes involving gears and belts, etc. such as described above and as illustrated in U.S. Pat. No. 3,661,383. Such systems are subject to difficult document retrieval should a jam occur, they are costly relative to the invention to be described herein, and are difficult to adjust and maintain.

The instant invention involves a configuration in which it is possible to drive an entire system of paper moving devices by providing only one set of driven rolls directly connected to a prime mover and using frictional contact between those rolls and additional sets of freely rotating rollers to obtain document recirculation. The freely rotating rollers are positioned in a pivoting frame which opens to expose the document feed path to provide for ease of document retrieval, ease of mechanism adjustment, ease of maintenance and easy book copying. This arrangement provides a reliable low-cost drive which is quiet and safe because of its freedom from belts, chains, or gears. This is also important from a safety viewpoint since recirculating document feed devices are in an area of user access.

An additional advantage of the invention is the ability to bias the side of a moving document against a side reference edge with a controlled force so as not to crumple the edge of the document by making use of the principles described in U.S. Pat. No. 4,179,117. In an especially innovative and advantageous design, the invention incorporates a large freely rotating roller which forms a part of two roll nips in two different document feed paths and thus creates unusual problems in document side edge referencing in both paths. The invention herein solves that problem.

Additionally, the beam strength of documents when driven around the substantially 180° bends of a recirculating document feed path creates slippage in roll nips and therefore unusual problems in maintaining alignment of the document against the side reference edge. Moreover, a document in two roll nips may be pulled through one nip by the other, again creating an unusual aligning problem. The invention herein provides a method for solving these problems.

SUMMARY OF THE INVENTION

This invention is embodied in a document feed device which includes a first set of roll nips provided in a first document path, the roll nips comprised of driven rolls and a first set of freely rotating rollers. The driven rolls are placed on the underside of the first document path protruding slightly above the plane of the path to individually mate with individual ones of the first set of freely rotating rollers which are thereby powered through contact with the driven rolls. A reference edge is provided along one side of the document feed path to provide a surface for referencing documents. The drive rolls and the first set of freely rotating rollers are skewed to the direction of document travel to urge documents against the reference edge.

The document feed device further includes a second document path for receiving documents from the exit of the first path and returning them to the entrance of the first path. The second document path contains a second set of roll nips comprised of two groups of freely rotating rollers. The first group of freely rotating rollers is situated on the underside of the second document path and each roller protrudes slightly into the plane of that path to mate individually with individual ones of the second group of freely rotating rollers. The second group of freely rotating rollers are powered through contact with the first group of freely rotating rollers which are powered ultimately by contact with the driven rolls. The first and second groups of freely rotating rollers are skewed to the direction of document travel in the second path to urge documents into a second reference edge positioned along one side of the second document feed path.

The document feed device contains a movable cover portion mounted about a pivot to expose the first document feed path, thus breaking the first set of nips when opened. When opened, none of the freely rotating rollers can operate since the only source of power is connected to the drive rolls which are not a part of the movable portion.

In a particular embodiment, large rollers are provided to form a part of both the first and second set of roll nips, that is, the large roller mates with a drive roll to form one of the first set of nips in the first document path and also extends into the second document feed path to mate with a roller of the second group of freely rotating rollers to form one of the second set of nips. In this embodiment, the driven rolls are skewed between zero and 0.4 degrees for urging a document away from the first reference edge, while the first set of freely rotating rollers, the large rollers are skewed between zero and 0.6 degrees for urging documents toward the first reference edge. The coefficient of friction of the first set of freely rotating rollers may be chosen to be greater than the coefficient of friction of the drive rolls.

In this particular embodiment, by virtue of the fact that the first set of freely rotating rollers protrude into both document feed paths and urge the document toward the reference edge in the first document feed path, it moves the document away from the second reference edge in the second document feed path. The second group of freely rotating rollers, therefore, should have an angle of skew and a coefficient of friction relative to the first set of rollers such that a proper alignment of the document is maintained in the second path. This requirement is met in the described embodiment in an unusual manner since the coefficient of friction of the roller urging the document toward the reference edge is substantially lower than the coefficient of friction of the mating roller. This method of arranging the rollers is advantageous due to slippage of the document in the roll nip during document movement toward the reference edge and allows the document to follow the lower friction roller when slippage is occurring on the higher friction roller. This results since the document, when slipping, will follow the roller on the non-driven side of the nip.

DETAILED DESCRIPTION

The document feed device of this invention is useful in many environments but is illustrated in this detailed description in conjunction with a document copier machine in order to explain its features and its value.

Figure 1:
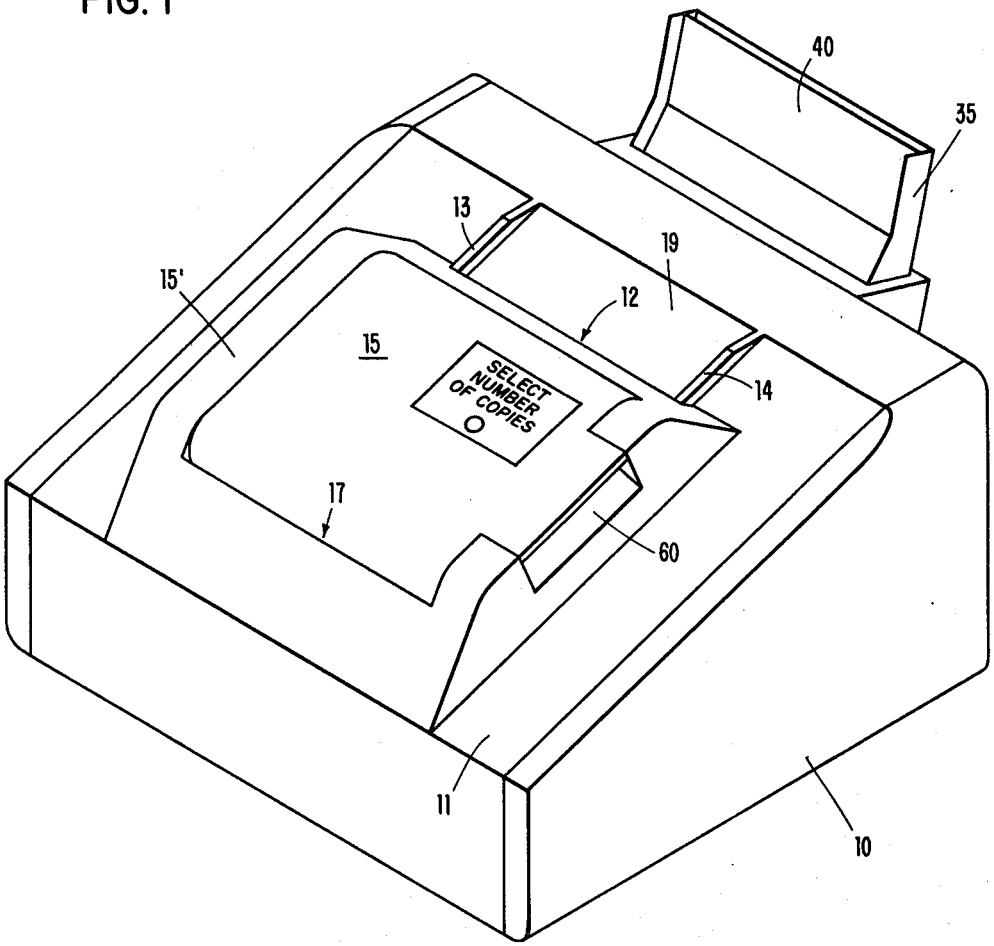
FIG. 1 shows a recirculating document feed device containing the instant invention positioned on a small compact copier machine.

FIG. 1 shows a document copier machine with an exterior housing 10 containing a top surface 11 inclined at an angle of approximately 20° to the horizontal. Positioned on that top surface is a document feed path 19, the sides of which are generally defined by reference edge 13 and spine 14. Document feed path 19 forms a part of a recirculating semiautomatic document feed device (RSADF) 15 together with hinged cover 15' and all associated drive rolls, freely rotating rollers, and guides. When cover 15' is closed as shown in FIG. 1, cover 15' and document feed path 19 provide an entry slot 12 for the insertion of single documents to be copied. After copying, these documents exit from the RSADF through an exit slot 17 located in cover 15'.

A paper cassette 35 is shown in place for feeding copy paper into the machine. The completed copy is returned against the face 40 of the cassette.

Figure 2:
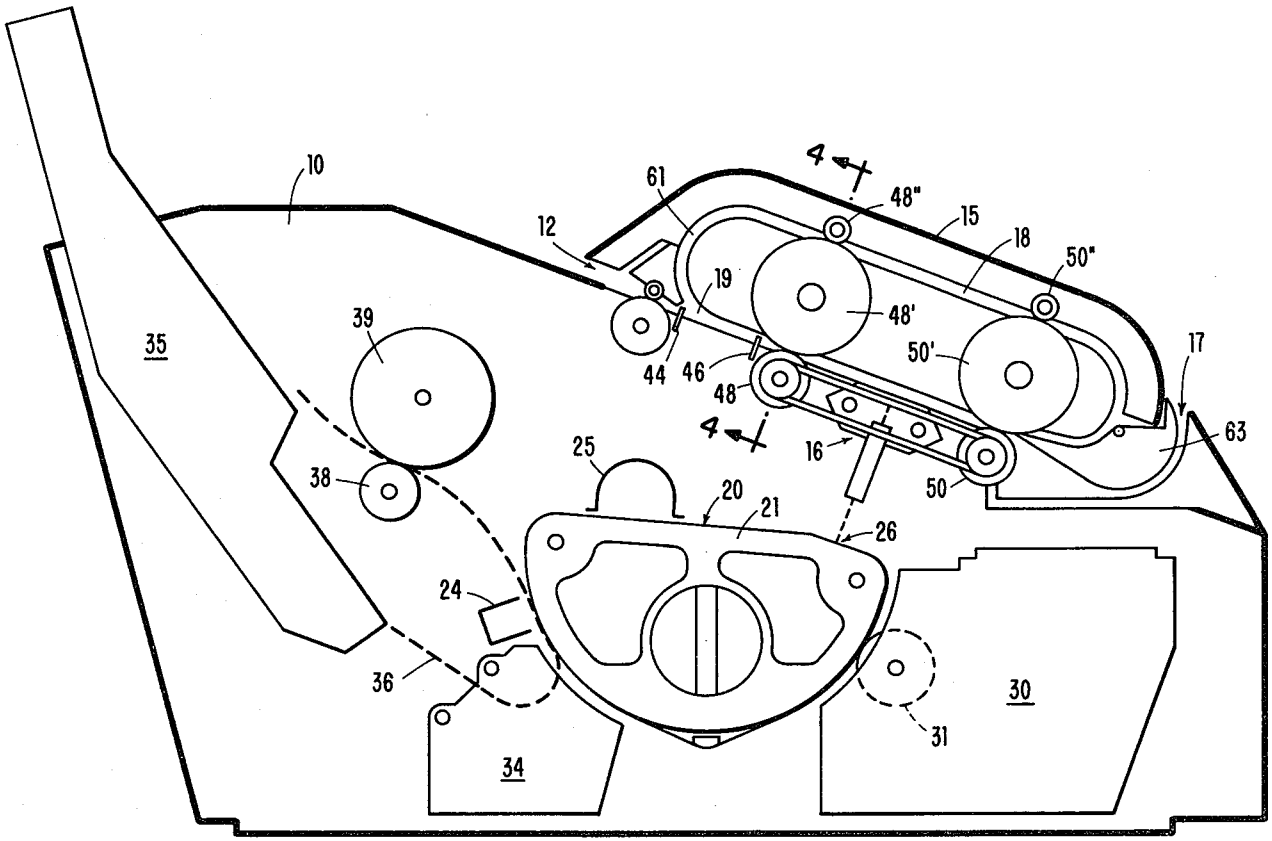
FIG. 2 is a schematic diagram showing the recirculating paper path of the embodiment of FIG. 1, together with the major elements of the copier machine.

FIG. 2 is a schematic drawing showing the interior side view of the copier machine of FIG. 1 illustrating the document path 18 of the recirculating semiautomatic document feed device 15. FIG. 2 also shows the copy paper path 36 from cassette 35 and the various processing stations located along photoconductive belt 20.

A document to be copied is manually inserted through input slot 12, where it is sensed and driven to queuing gate 44. If no other document is being copied, gate 44 is released allowing the document to advance to registration gate 46. When the machine is ready, gate 46 is released allowing drive rolls 48 and 50 to move the document across the fiber optic viewing station 16. The original document, after processing, is either delivered to the exit slot 17, or is recirculated for multiple copies by return paper path 18 as determined by the position of gate 63. Gate 63 is automatically positioned in accordance with the number of copies selected by the operator and a count of the number of copies already produced from that original document.

The image of the original document thus scanned is placed upon a continuous loop photoconductor (PC) belt 20, which is retained in place by means of a guide frame assembly 21.

The copier machine shown in FIG. 2 takes an electrophotographic two-cycle process configuration wherein corona 25 operates as a charge corona to place an appropriate electrostatic voltage level on PC belt 20. The image of the original document is placed upon belt 20 at imaging location 26 by selective discharge, based upon the information contained in the original document. This image is then developed by developer unit 30 which places toner on appropriate areas of belt 20 as it passes the magnetic brush roller 31.

The paper gating mechanism 34 controls the introduction of copy sheets from cassette 35 to the photoconductor belt 20 in appropriate synchronism with the movement of the toned image on belt 20. Corona 24 operates as a transfer corona to transfer toner from belt 20 onto the copy sheets. The copy sheets continue to the fuser comprised of rollers 38 and 39 where the toner image is fused to the copy sheet. The toned copy sheet is then exited from the machine.

Figure 3:
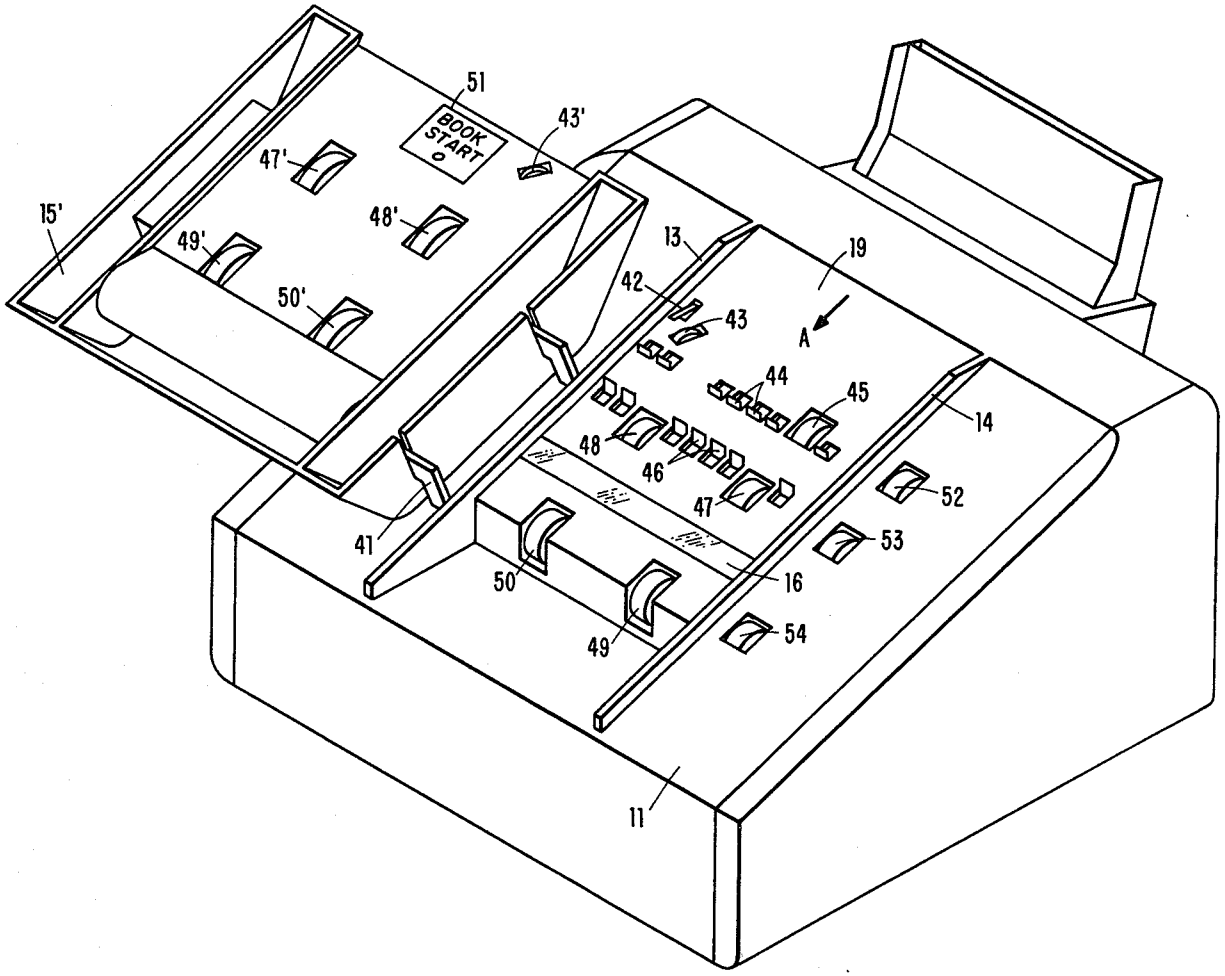
FIG. 3 shows the document feed device of FIG. 1 pivoted to an open position exposing the lower document feed path.

FIG. 3 shows the machine of FIG. 1 with the cover 15' of the recirculating document feed device 15 rotated around the hinges 41 to an open position. In this position, the entirety of the document feed path 19 along the top surface 11 is exposed to view. FIG. 3 shows document feed path 19 with a document reference edge 13 along one side and a spine or rail guide means 14 positioned along the opposite edge. Entry sensor 42, aligner roll 43, queuing gate 44 and registration gate 46 precede viewing station 16 in paper feed direction A. All document moving rolls protrude above the plane of top surface 11 with rolls 45, 47, 48, 49 and 50 lying within path 19 and rolls 52, 53 and 54 located across the rail guide means 14 outside of the document path.

The open cover 15' in FIG. 3 shows the corresponding rollers 43', 47', 48', 49' and 50' which mate with the rolls on the top surface 11 to form roll nips when the cover 15' is closed. The open cover in FIG. 3 also exposes a manual start button 51 for use when copying books.

When a single sheet is to be copied and document feed cover 15' is in place, entry switch 42 automatically starts machine operation when the document is sensed, and aligning roll 43 operates to position the single sheet against reference edge 13 and queuing gate 44. After alignment, and if there is no preceding sheet in the device 15, gate 44 is dropped and mating rolls 43 and 43' move the paper down the feed path 19 in direction A to registration gate 46. At the proper point in the machine cycle, gate 46 is dropped allowing rolls 43, 47 and 48 to move the document across a stationary elongated document viewing station 16, the major dimension of which is perpendicular to feed path direction A. Rolls 49 and 50 continue to move the document out through exit slot 17 or around through the return paper path 18 if multiple copies are to be made.

If multiple copies are being made, the sheet recirculates through document path 18 shown in FIG. 2 until it returns to gate 46. Again, at the proper point in the machine cycle, gate 46 will drop initiating another copy sequence. During this period of recirculation, a next sheet can be inserted by hand to aligning roll 43 and moved against the queuing gate 44. In that manner, once the required number of copies have been made of the first document and it has exited through slot 17, gate 44 will drop allowing the second document to proceed to gate 46 and repeat the cycle.

Rolls 45, 52, 53 and 54 together with spine 14 are provided for copying books as more fully explained in U.S. patent application Ser. No. 296,683.

A comparison of FIGS. 1 and 3 show that the document feed device 15 contains a lightweight, easily movable cover portion 15' pivoted by hand to an open position by grasping cover 15' at hand grip 60. This ease of movement is made possible by the fact that none of the rollers mounted in the pivoting cover 15' are driven except through contact with the drive rolls when the cover is closed. As may be observed in FIG. 3, this provides an added safety feature since none of the rollers 43', 47', 48', 49' or 50', which are exposed when the cover 15' is open, are driven when the machine is used for copying a book along the exposed paper path 19.

Figure 4:
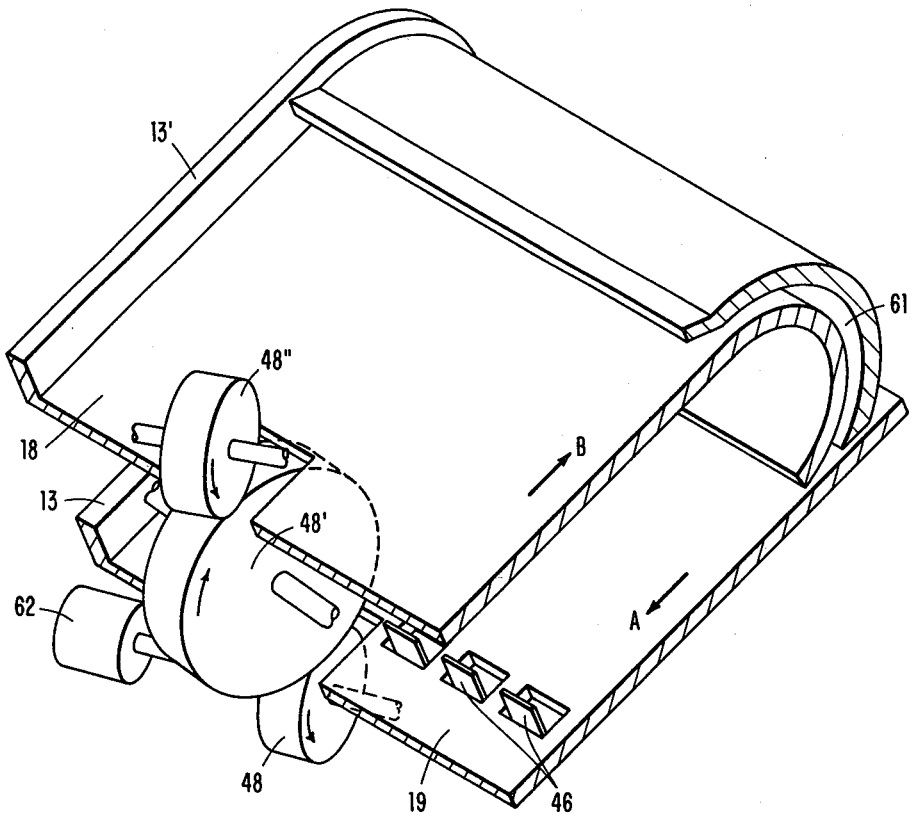
FIG. 4 is a perspective drawing of a partial sectional view of FIG. 2 showing the skewing arrangement of drive rolls and freely rotating rollers in order to urge document alignment with the reference edges.

Referring now to FIGS. 2 and 4, the drive mechanism for recirculation of documents is illustrated. Drive rolls 48 and 50 are positioned on the underside of first document feed path 19 protruding slightly through the plane of that path to form a first driving nip with freely rotating rollers 48' and 50'. In the embodiment illustrated, the latter rollers are large in circumference and extend upwardly to protrude slightly into second document feed path 18 to form a second nip with freely rotating rollers 48" and 50". Exactly the same construction is present for roller groups 49, 49', 49" and 47, 47' and 47" so that the groups of rollers form sets of nips, a first set of nips in document feed path 19, and a second set of nips in second document feed path 18.

A drive motor 62 is shown in FIG. 4 connected to drive roll 48. Suitable connecting transmissions, not shown, connect motor 62 with the other drive rolls. Motor 62 may also drive other components within the copier machine if desired. It should be noted that in the embodiment shown in FIGS. 1–4, the nonpivoting portion of document feed device 15 is a part of the copier machine itself, that is, the first document feed path 19 is coincident with the top surface 11 of the copier machine 10.

In operation, a paper is fed by hand through entry slot 12 and after queuing at gate 44 and registering at gate 46 as previously described is fed into that portion of document feed path 19 containing the rollers 47 and 48. These rollers with the associated freely rotating rollers 47' and 48' move the document across viewing station 16 and into the nip of rollers 49, 49', and 50, 50'. If multiple documents are to be made, the document is recirculated into the second document feed path 18 where the document is fed in direction B through the rollers 50', 50" and 49', 49" and into the nips of rollers 47', 47" and 48', 48". The leading edge of the paper is then fed around bend 61 and back into first paper path 19 to register against gate 46 prior to beginning the next cycle.

As may be appreciated, it is important to maintain proper document position against reference edge 13 while the document passes across the viewing station 16. As a consequence, rollers 48 and 48' are skewed to direction A, that is, the direction of document movement along paper path 19 so that the paper is urged toward reference edge 13. FIG. 4 shows that roller 48' is positioned at an angle such that it tends to drive the paper toward reference edge 13 while roll 48 is skewed to direction A in a manner such that it tends to urge the document away from reference edge 13. In a preferred embodiment, roller 48' is positioned at an angle between zero and 0.6 degrees into the reference edge, while the drive roll 48 is positioned at an angle between zero and 0.4 degrees away from the reference edge. One can be assured that the document will be moved toward the reference edge if roller 48' is caused to have a higher coefficient of friction than roll 48. The advantage of skewing roll 48 to urge the paper away from the reference edge is that this provides control over the force moving the paper into the reference edge and thus prevents a crumpling of the paper when it engages with edge 13. It should be understood that once the document edge is aligned against the reference edge, slippage in the roll nip must occur to keep the document from crumpling and thus control over the forces moving the document into the reference edge is important. Again, that subject is fully discussed in above-referenced U.S. Pat. No. 4,179,117.

As one can appreciate from FIG. 4, when large roller 48' is positioned to urge paper toward reference edge 13 in paper path 19, it results in moving paper away from reference edge 13' when the paper is moving in second document feed path 18. Thus, freely rotating roller 48" is skewed to the direction of document movement B to urge the documents towards reference edge 13'. Again, by choosing the coefficient of friction of roller 48" to be greater than roller 48', one can be assured of moving the paper toward reference edge 13'. However, in a preferred embodiment of this invention, roller 48" is chosen to take a lower coefficient of friction than roller 48' for the following reasons. As paper is moved around bend 61, the beam strength of the paper tends to cause a high drag force in the nip of rollers 48', 48" which tends to create slipping in the roll nip. When slipping, the document tends to follow the roller on the nondriven side of the nip and thus the leading portion of the document is correctly positioned against the reference edge by skewing roller 48" toward the reference edge. This is advantageously accomplished by a low friction roller since it is important to limit the force moving the document into the reference edge once the document is against the reference edge. Slippage between the document and the roller on the nondriven side of the nip must occur at that point to avoid crumpling the document.

When the leading edge of the document has passed around bend 61 and enters the nip of rolls 48 and 48', it tends to be pulled through the nip of rollers 48' and 48" thus again creating slippage at that nip. As a result of that slippage, the document again tends to slip on roller 48' which is on the drive side of the nip (although not itself directly driven) and to follow the lower friction roller 48" on the nondriven side of the nip. Thus the trailing portion of the document is correctly positioned against reference edge 13' and the low coefficient of friction of roller 48" prevents document crumpling at the reference edge.

In a preferred embodiment, roller 48' is positioned between zero and 0.6 degrees in a manner tending to urge the paper away from the reference edge in the second paper path 18 while freely rotating roller 48" is skewed at an angle between 1° and 15° to the direction of paper movement tending to urge the document toward the second reference edge 13'. A representative coefficient of friction may be 0.6 to 1.5 for roller 48' and 0.4 or less for roller 48". A similar analysis can be made for rollers 47' and 47".

Thus, a recirculating document feed device has been described which requires no driven components in a hinged cover and in which documents are successfully aligned against reference edges for accurate copying even though slippage is present in roll nips while the document is being moved toward the reference edge. There are modifications to the embodiments described which might be made at one's discretion. For example, the single large rollers 47', 48', 49' and 50' could be replaced by a plurality of rollers and various skewing arrangements might be attempted with different device dimensions and/or configurations.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. The method of aligning the side of a document against a reference edge which is located parallel to the direction of document travel, and in which said document is moved through the nip of rollers in which said document may slip while it is being moved toward the reference edge, comprising the step of:

skewing a first roller on the drive side of the nip to the direction of document travel in a manner to provide a force component away from said reference edge;

skewing a second roller on the nondriven side of the nip to the direction of document travel in a manner to provide a force component toward said reference edge so that when said document slips on said first roller it tends to follow said second roller toward said reference edge; and providing said second roller with a lower coefficient of friction than said first roller to avoid crumpling said document when it is against said reference edge.

2. The method of claim 1 in which the skew of said first roller is set close to zero degrees so that said document is not driven too far away from said reference edge during that portion of document travel when it does not slip in said roll nip.

3. The method of claim 2 in which the skew of said second roller is substantially greater than the skew of said first roller.

* * * * *